United States Patent [19]

D'Agnolo

[11] Patent Number: 5,066,190

[45] Date of Patent: Nov. 19, 1991

[54] DEVICE TO PALLETIZE YARN PACKAGES

[75] Inventor: Armando D'Agnolo, Porcia, Italy

[73] Assignee: Matics Srl, Pordenone, Italy

[21] Appl. No.: 446,664

[22] Filed: Dec. 6, 1989

[30] Foreign Application Priority Data

Dec. 23, 1988 [IT] Italy ..... 83552 A/88

[51] Int. Cl.[5] ..... B65G 57/16

[52] U.S. Cl. ..... 414/799; 414/789.5; 414/789.7; 414/790.7; 414/791.6; 414/908; 414/927

[58] Field of Search ..... 414/789.5, 790.7, 791.6, 414/924, 927, 789.7, 790, 908, 911, 792.9, 799; 57/281

[56] References Cited

U.S. PATENT DOCUMENTS 4,850,783 7/1989 Maekawa ..... 414/792.9

FOREIGN PATENT DOCUMENTS 3244925A 6/1984 Fed. Rep. of Germany .
3714057 11/1988 Fed. Rep. of Germany ... 414/792.9
2417457 10/1979 France ..... 414/792.9
1214155 3/1987 Italy .
1-13331 1/1989 Japan ..... 414/789.7

OTHER PUBLICATIONS

1236 Melliand Textilberichte, International Textile Reports 65 (1984), Aug., No. 8, Wurzburg, Deutschland, pp. 501-505.

*Primary Examiner*—David A. Bucci
*Assistant Examiner*—Janice Krizek
*Attorney, Agent, or Firm*—Nixon & Vanderhye

[57] ABSTRACT

Device to palletize yarn packages which is suitable for installation downstream of machines (11-111) that produce yarn packages, such as winding machines, fly frames, finishing machines, open-end spinning machines, two-for-one twisting machines, etc., the yarn packages (12) being engaged substantially at the outlet of their production machine (11-111) so as to be loaded in an orderly manner on pallets (32), on feed boxes (46) or other devices suitable to support the yarn packages (12), the palletization device (10) consisting of a movable (23) structure (22) able to support devices (14-16-17-18) that transfer the yarn packages (12), devices (15) to control and/or orient and possibly process the yarn packages (12), devices (19-20) that engage, move and position the yarn packages (12) and structures (45) that engage, move and position cardboard sheets (30) and pallets (32), the device (10) taking up at least two side-by-side work stations (24-124) within the structure (22), these work stations (24-124) being equipped with an apparatus (25-43) suitable to support and move yarn package supports (32-46) and cardboard sheet supports (32) or other auxiliary supports in two directions (28) orthogonal to the direction of forward movement (29) of the palletization device (10), whereby this orthogonal movement in two directions (28) can be carried out on both sides of the device (10).

13 Claims, 4 Drawing Sheets

DEVICE TO PALLETIZE YARN PACKAGES

BACKGROUND OF THE INVENTION

1. Field of the Invention

This invention concerns a device to palletise yarn packages which is suitable to be fitted downstream of yarn package production machines such as winding machines, fly frames, high-draft finishing machines, open-end spinning machines, two-for-one twisting machines, bobbin winders, take-up headstocks for synthetic yarns,etc.

2. Discussion of Prior Art

Such yarn packages may be formed of threads of continuous fibres, such as manmade fibres for instance, or of threads of discontinuous fibres, such as wool, cotton, etc. for instance.

To be more exact, this invention concerns a device able to transfer the yarn packages produced from a yarn package production machine and to load those packages in an orderly manner on pallets, in boxes or on any other means suitable for the purpose.

The device of the invention comprises means suitable to support the yarn packages being palletised or packed, such means being also able to cooperate momentarily with storage zones for the palletised or packed yarn packages.

The words "yarn packages" are used here as a generic name for any type of yarn package or roving package normally wound in cylindrical or truncated-cone packages since the invention is suitable for all applications like those cited herein.

It is known that yarn packages in the textile industry are handled by means of creels, support with bars, pallets, etc.

The yarn packages are taken from their production machines and are generally stored momentarily on supports by hand or by the employment of robots, which engage one or more yarn packages at a time and deliver them to a provisional support.

The yarn packages are conveyed thereafter to the next processing stations, where they are taken from the provisional support.

There are cases in which the yarn packages require a final or almost final packaging while still at their production machine, namely when the yarn packages are intended for dispatch and have to be positioned in an orderly manner on pallets, in boxes or on other suitable supports.

The problems linked to the engagement and delivery of yarn packages are known both as regards the work involved and the relative costs.

DE 3.244.925 discloses a robotized device which performs a to-and-fro activity, engaging one or two yarn packages at a time and delivering them to the pins of a creel. This robot has to carry out all the movements and positioning each time with relatively long working times.

Moreover, this robotized device entails structural limitations of its usage since creels which are too long or too high involve such heavy downtimes that this device becomes unworkable.

Furthermore, the reciprocal positioning of the production machine, robotized device and creel, or transient support or momentary storage point, has to be very accurate, for otherwise the system does not work.

Besides, the robotized device requires the employment of complex programming, controlling and governing systems and therefore entails high costs of manufacture, working and maintenance.

The trade journal "Melliand Textilberichte, International Textile Reports" 65 (1984) Aug., No. 8, Wuerzburg, Germany shows on page 504 a robot cooperating with a plurality of machines, which in this case are open-end spinning machines. The robot is installed on a trolley able to move crosswise to the open-end spinning machines and engages the yarn packages discharged from each spinning machine so as to arrange them on pallets.

Besides the drawbacks described earlier, a device of this type is suitable to make up a complete pallet load with the yarn packages taken from a spinning machine but does not comprise means to convey partly completed pallet loads to storage zones and to bring the pallets back later for completion of the pallet load.

IT 83325 A/86 belonging to the present applicant indicates embodiments suitable to overcome the above problems, but the device disclosed in this document concerns substantially the loading of momentary storage points in general and it is not intended to serve a specific type of support such as a pallet unless it is equipped with expensive and complicated special means which cannot be compared with a precisely prepared device from a functional point of view.

IT 83324 A/87 belonging to the present applicant discloses a method to load yarn packages on transient storage points, whereby the presence of the storage point is checked and the required position for loading the yarn packages on the storage point is identified.

IT 83366 A/88, also belonging to the present applicant, discloses a device suitable in a specific way to engage and load yarn packages in an orderly manner on pallets. This device is particularly intended for the complete or partial formation of pallet loads on pallets which are normally left at the formation point or close thereto.

Likewise, the auxiliary materials required for the packaging such as cardboard sheets or wooden pallets are taken preferably from appropriate storage points located at the pallet load formation position.

The present applicant has designed, tested and embodied a device suitable to handle textile yarn packages for their orderly positioning on pallets or in feed boxes or other suitable supports in superimposed layers.

The invention is set forth in the main claim, while the dependent claims describe various characterizations of the invention.

The present applicant has the purpose of achieving a plurality of advantages, the main one of which is to have available a multipurpose device able to overcome any problem concerning the lay-out and the yarn package production machines and linked to the loading of yarn packages on pallets or the like.

The device must possess in particular its own independence regarding supplies of accessories required for the pallet, such as cardoboard sheets and wooden supports, and must be able to carry out movement of the pallets both in the zones neighbouring the yarn packaging position and in distant zones such as storage points far from the department where the yarn packages are formed.

The device of the invention can also work as a stationary unit at an appropriate point for collection of the plurality of yarn packages; this point will be located far from the units which form the yarn packages.

These and other purposes and the relative advantages and still further advantages will be made clear hereinafter.

SUMMARY OF THE INVENTION

The invention arranges to transfer the yarn packages discharged from the production machines to the palletisation zone by means of a coordinated conveyor system consisting of such elements as belts, chains, tracked means or equivalent means of the state of the art.

The yarn packages, therefore, suitably oriented and possibly checked and/or processed, are fed to the actual palletisation assembly, which has the task of arranging the yarn packages at required places according to a predetermined logic so as to form the loads of yarn packages on pallets. In the disclosure hereinafter we shall refer specifically to pallets, but the same considerations can be applied to feed boxes, creels with pins or any other means available to lodge the yarn packages in an orderly manner. According to a preferred embodiment the device of the invention is of a movable type, and we shall refer to such a type hereinafter in the description. The description so far is covered by the state of the art. The device according to the invention consists of a structure on the base of which are ..at least two substantially parallel, coplanar work stations. Movable elements, advantageously trolleys are secured to the structure of the device in these work stations.

These trolleys are structured so as to support, during their conveying movements, the yarn packages being arranged or already loaded on the pallets together with the relative cardboard sheets and the pallets themselves.

So as to form the pallet loads, each trolley can be moved vertically to cooperate suitably with the actual palletisation assemblies.

The trolley can also stay at the base of the palletisation device, while only the pallet with any yarn packages placed on it is moved vertically.

The trolley is also equipped with means able to displace the trolley sideways to the direction of movement of the palletisation device, so that the trolley is positioned clear of the overall bulk of the device when the trolley is in its lowest position in relation to the ground.

During its sideways displacement the trolley cooperates with guide mean suitably positioned in correspondence with the zones of the passage of the palletisation device.

A configuration such as that described above makes possible many operational capabilities and many uses within various productive lay-outs; among these capabilities we shall mention two particularly significant ones.

A first capability exists when the device is used to serve machines the yarn package discharge of which does not enable a complete pallet load to be loaded in one single operation, for instance winding machines; in that case the device will have a first work station equipped with a first trolley to load a pallet partially and to position that pallet in a waiting area near the machine where the pallet will be used again in a subsequent operation of the device.

The second work station will be equipped with a second trolley to bear separator means for insertion between one layer and the next of yarn packages deposited on the pallet being loaded. This trolley is also able to cooperate with organized storage points of cardboard sheets, of which the device will make use when necessary.

The device may also bear pallets which can be taken when a new load of yarn packages is started.

The second capability is available when the device is used to serve machines the yarn package discharge of which enables a complete pallet load to be loaded in one single operation, as is the case with the majority of open-end spinning machines. In this case the device according to a variant of the invention has work stations equipped with powered rollers or chains or other assemblies able to cooperate with analogous devices included in the storage areas of complete pallet loads.

The device prepares a complete pallet load at its position and uses the cardboard sheets it is carrying; it then conveys and places the fully loaded pallet at positions generally far from the yarn package production zone, where it takes an empty pallet and replenishes the cardboard sheets, if necessary.

These and other special features will be made clearer in the description which follows.

BRIEF DESCRIPTION OF THE DRAWINGS

The attached figures, which are given as a non-restrictive example, show the following.

DETAILED DESCRIPTION OF PREFERRED EMBODIMENTS

In the figures a palletisation device 10 according to the invention is located downstream of machines 11 and 111 which produce yarn packages 12, and cooperates with a discharge 13 of yarn packages 12.

Figure 5:
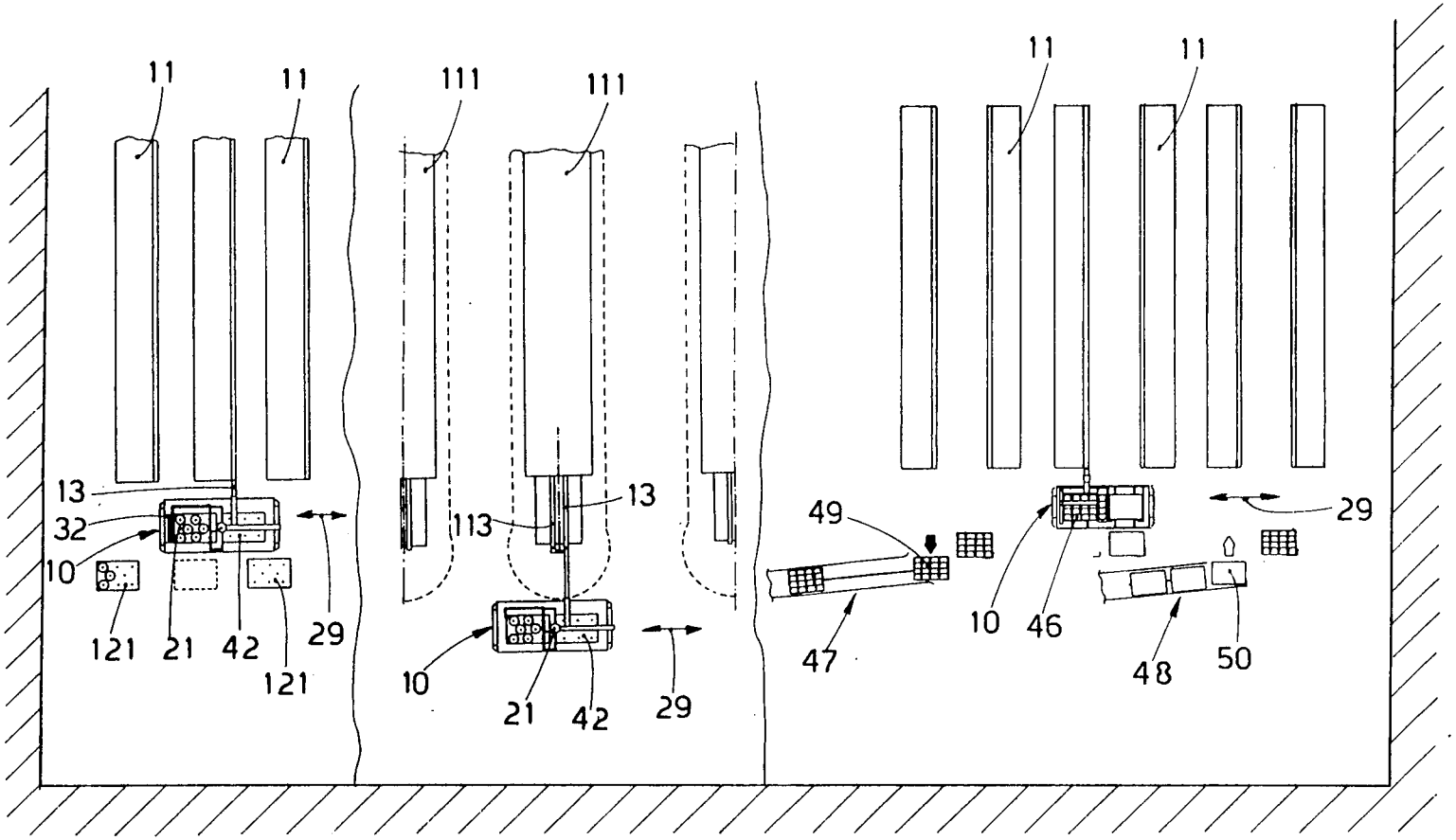
FIG. 5 shows some plant lay-outs making use of the device according to the invention.

The machines 11–111 which produce yarn packages 12 are shown diagrammatically in fig.5 and in this example are automatic winding machines 11 and open-end spinning machines 111 but may be of any type.

Figure 1:
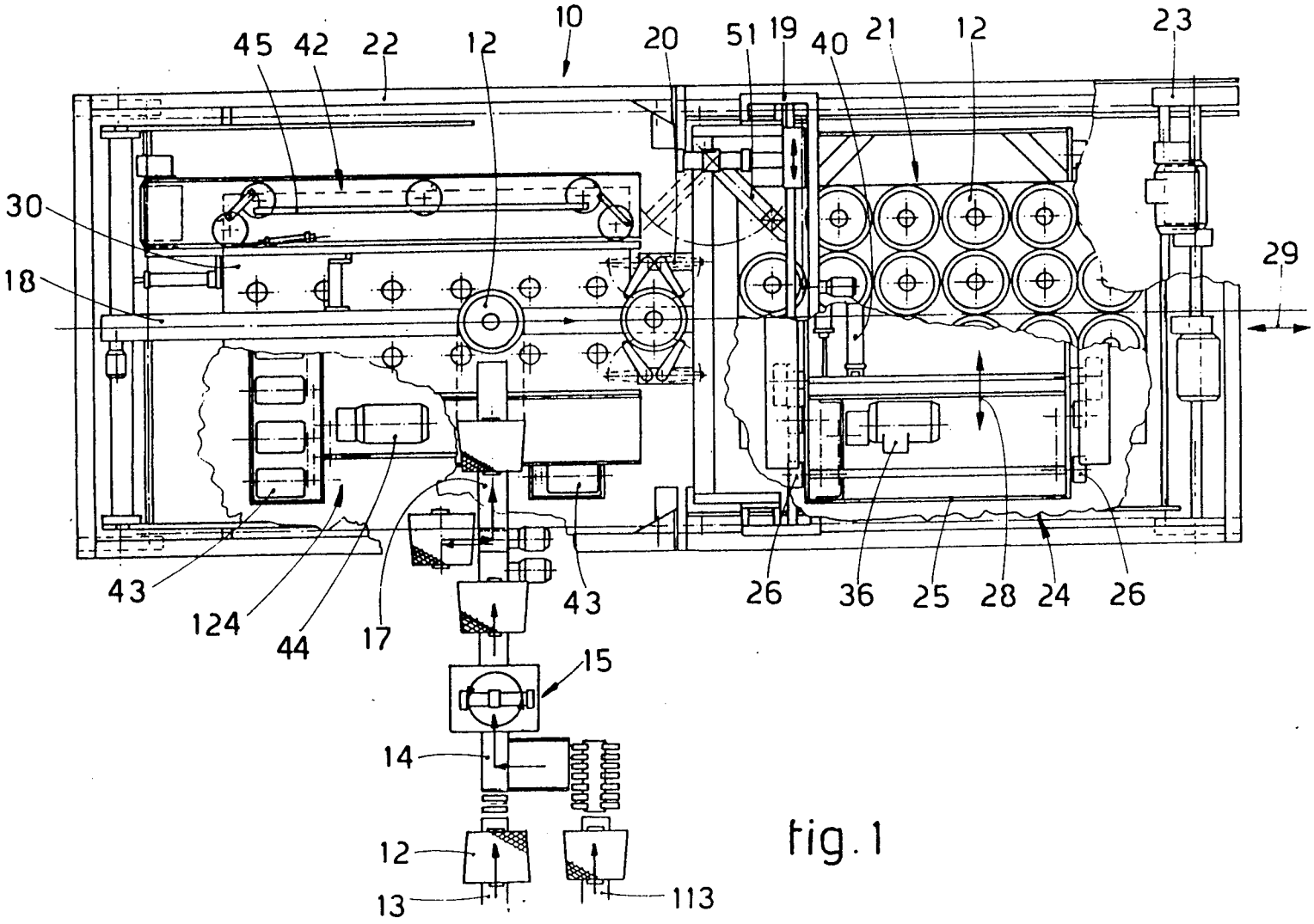
FIG. 1 is a diagrammatic plan view of a device according to the invention.

The example of FIG. 1 deals with open-end spinning machines 111 and shows two discharges 13 and 113 of yarn packages 12.

The palletisation device 10 has a configuration substantially of a known type and includes the following main assemblies:

- a conveyor 14 to feed yarn packages 12 from their discharge points 13–113 to the palletisation device 10;
- a control station 15 located on the feeder conveyor 14, where the yarn packages 12 are suitably controlled and/or oriented and corrected, if necessary and requested;
- an elevator 16 which takes the yarn packages 12 from the feeder conveyor 14 and lifts them to the upper part of the palletisation device 10;
- a horizontal conveyor 17 which receives and traverses the yarn packages 12 and is equipped with means for vertical orientation of the same 12;
- a positioner conveyor 18 able to move lengthwise to receive and convey the yarn packages 12;
- means 20 to align the yarn packages 12;
- a slider element 19 connected to the positioner conveyor 18 and able to move lengthwise therewith;

assemblies 51 which engage and transfer the yarn packages 12 and are integrally fixed to the slider element 19 and which perform the positioning of the yarn packages 12 on a pallet 21 being loaded, the positioning being carried out according to a pre-set logic;

means to actuate the above assemblies, the whole system being supported on a structure 22 fitted with wheels 23 for its movement in a direction at a right angle to the axis of the machines 11-111 which produce yarn packages 12.

The palletisation device 10 according to the invention comprises two work stations 24 and 124, which may be substantially equivalent to each other and be intended to perform the same operations or may be differentiated and may complement each other.

The partly cutaway righthand portion of FIG. 1 shows the first work station 24, which comprises in a preferred embodiment of the invention a trolley 25 able to move on wheels 26 in guides 27 according to the arrows 28 crosswise to the direction according to the arrows 29 of movement of the palletisation device 10.

In this way the trolley 25 can take up momentary positions of an equivalent area on either side of the device 10.

Figure 4:
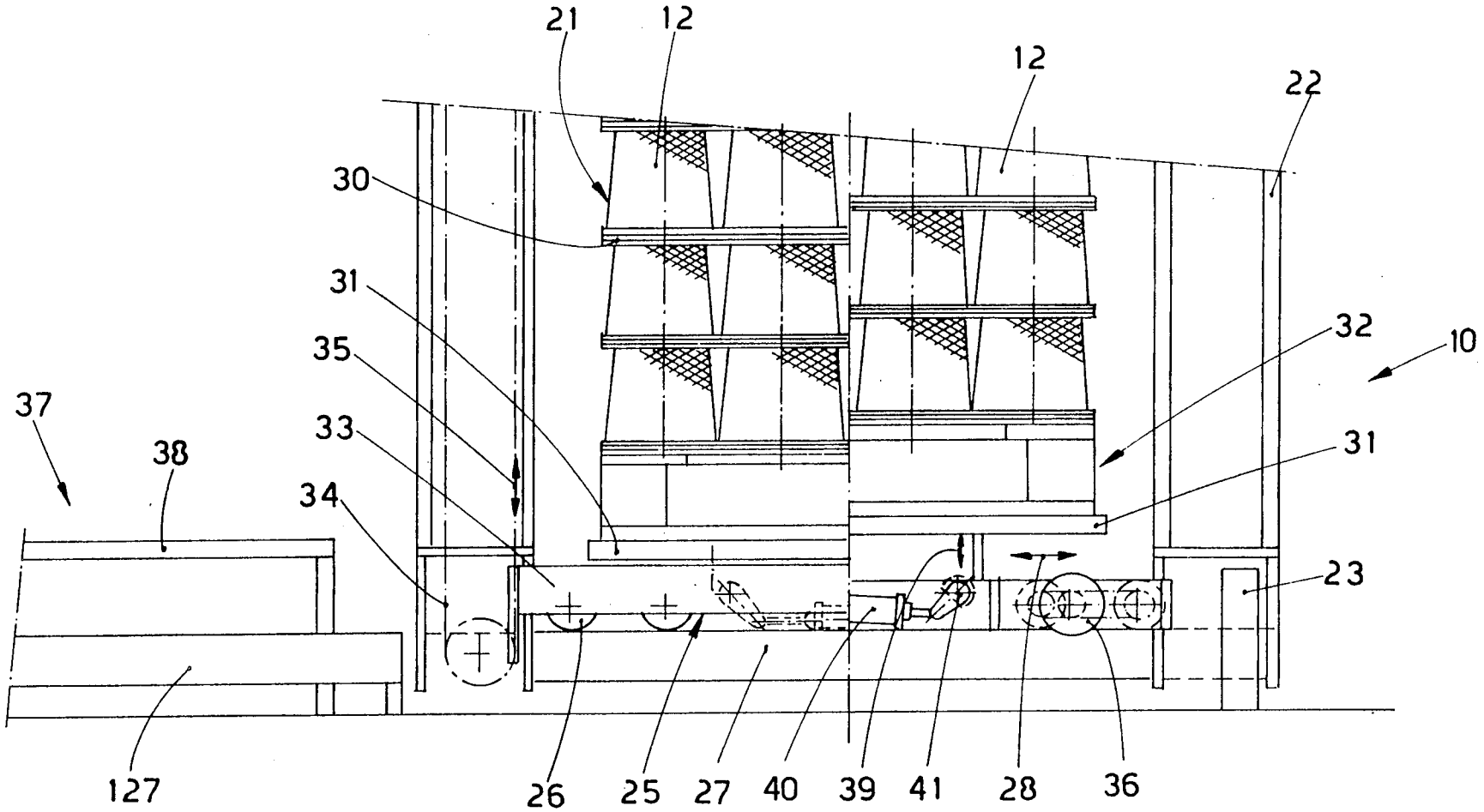
FIG. 4 is a diagrammatic side view of a trolley of the device of FIG.1.

The righthand half of FIG. 4 shows a trolley 25 bearing yarn packages 12 in a stack 21 on a pallet 32, the yarn packages 12 being arranged in an orderly manner in layers separated by cardboard sheets 30.

The trolley 25, which can run on guides 27 forming an integral part of the structure 22, consists of a frame which support a pallet-holder platform 31 that cooperates with the pallet 32 bearing the stacked yarn packages 21.

During the step of loading, the pallet 32 is connected by elevator plates 33 to lifter means, for instance chains 34, solidly fixed to the structure 22.

According to a variant the elevator plates 33 are connected to the pallet 32 alone, and in this case the trolley 25 will remain on the ground during the lifting.

The chains 34 perform the initial vertical lifting of the trolley 25 together with the pallet 32 and first cardboard sheet 30 according to the arrows 35 so as to obtain the loading of the first layer of yarn packages 12.

The trolley 25 in conjunction with the pallet 32 and first cardboard sheet 30 will be lowered step by step thereafter by a height corresponding to each layer of yarn packages 12 to be loaded.

When the loading of yarn packages 12 on the pallet 32 has been carried out wholly or partly as required, the trolley 25 is traversed sideways according to the arrow 28 by its own means 36 that actuate its wheels 26.

The purpose of this is to move the pallet load 21 so as to place it in stationary stations 37 corresponding to the discharges 13-113 of the production machines 11-111 or at other appropriate storage sites.

The stationary stations 37 comprise advantageously guides 127, like the guides 27 of the device 10, and comprise also pallet supports 38, on which the pallet load 21 of yarn packages 12 on the pallet 32 borne by the trolley 25 is rested.

For this purpose the pallet-holder platform 31 can move vertically according to the arrows 39, as shown in the righthand half of FIG. 4, by an amount required to position and release the pallet load 21 on the pallet support 38 of the stationary station 37 located outside the palletisation device 10.

The trolley 25 is equipped with its own lifting means, such as jacks 40, levers 41, etc., suitably connected together so as to ensure horizontal leveling of the pallet-holder platform 31 during the lifting operation.

The second work position 124 of the palletisation device 10 may be equipped in the same way as the first work station 24 described above.

In this case the equivalent trolley 25 will be used advantageously as a support for a pallet 42 holding cardboard sheets, this pallet 42 being used as a store for the cardboard sheets 30 during the loading of yarn packages on the pallet 32 of the first work station 24, the pallet 42 with cardboard sheets being moved in coordination with the elevation of the yarn packages during the loading.

Figure 3:
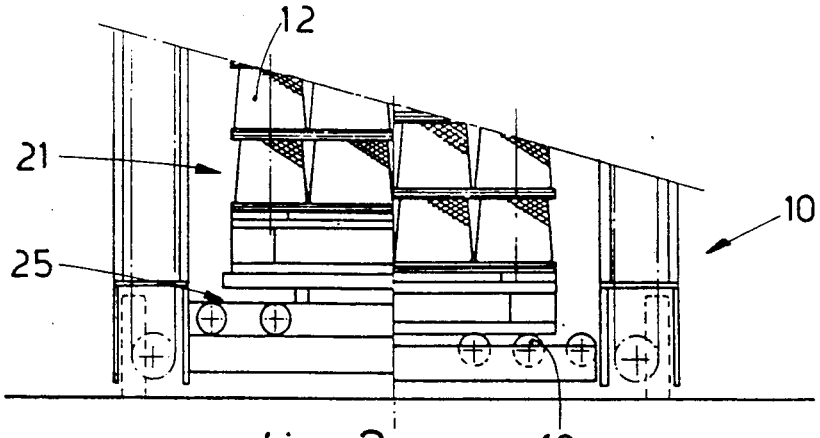
FIG. 3 is a partial side view of the other side, in relation to FIG. 2, of the device of FIG. 1.
Figure 2:
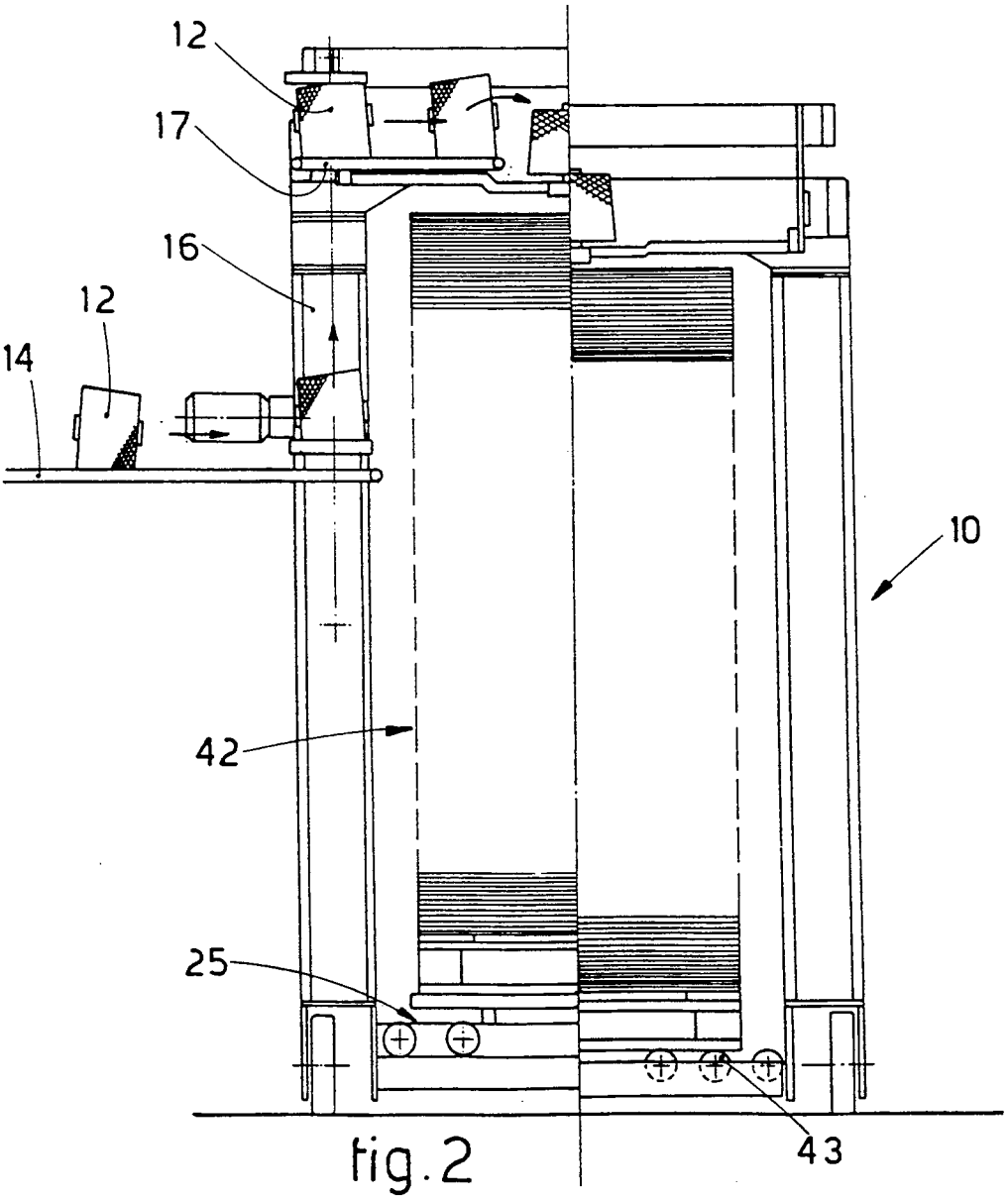
FIG. 2 is a partial side view of one side of the device of FIG. 1.

The lefthand halves of FIGS. 2 and 3 give a side view of the two sides of the palletisation device 10 with the trolleys 25 described above and employed respectively to support and displace the pallets 42 with cardboard sheets and the pallet loads 21 of yarn packages 12 on the pallets 32 of the first work station 24.

The first 24 and second 124 work stations may be structured differently, for instance when serving open-end spinning machines 111 where a complete load 21 of yarn packages is usually loaded during one single operation of the device 10.

In such a case the second work station 124 may be structured as shown in the lefthand half of FIG. 1, in which roller conveyors 43 equipped with their own motor 44 can be seen. Such roller conveyors 43 may, instead, be other analogous assemblies such as chain assemblies.

A pallet 42 holding cardboard sheets 30 and/or a pallet 32 holding yarn packages 12 may be rested on the roller conveyors 43.

Vertical elevator means to lift loaded pallets 21 and pallets 42 holding cardboard sheets 30 are included also, just as in the case of the trolleys 25.

The roller conveyors 43 may cooperate advantageously with like roller conveyors comprised at the positions where pallets 32 loaded with yarn packages 12 or pallets 42 loaded with cardboard sheets 30 are located.

The lefthand side of FIG. 1 shows also a means 45 to engage cardboard sheets which is of a mechanical type solidly fixed to the structure 22 and is able to take, by means of an articulated lever system, each cardboard sheet 30 from the pallet 42 holding these sheets and to bring the sheet to each layer of yarn packages 12 being formed on the pallet 32.

This means 45 to engage cardboard sheets cooperates with lifter means 34 analogous to those cooperating with the pallet 32 of the first work position holding the yarn packages 12.

The righthand halves of FIGS. 2 and 3 show a lay-out with roller conveyors 43 cooperating with a pallet 42 holding cardboard sheets 30 and a pallet 32 holding yarn packages 12 respectively.

FIG. 5 shows three possible lay-outs which can be obtained with the palletisation device 10 of the invention.

At the left of FIG. 5 the device 10 serves automatic winding machines 11 and moves sideways to the axis of these machines 11 according to the arrows 29.

The device 10 most often carries a pallet 42 holding cardboard sheets and taken from an appropriate storage point far from the yarn package production zone.

In another configuration the device 10 may engage by means of the trolley 25 a pallet 42 holding cardboard sheets 30 and located in the zone where the yarn packages 12 are wound; this pallet 42 holding cardboard sheets may be used partly and then deposited by the device 10 in its depositing area before the device passes on to serve the next winding machine 11.

The palletisation device 10 may load a pallet 32 fully with yarn packages 12 and may have available a pallet or pallets 32 borne by the device 10 itself.

The embodiment shown indicates a pallet 32 borne within the device 10 and moved thereby when necessary.

In the situation shown on the lefthand side of FIG. 5 the trolley 25 more often takes a pallet 32 partly loaded with yarn packages and proceeds with the loading, thereafter repositioning the pallet in a waiting position or else completes the loading and conveys the pallet load advantageously together with the device 10 to an appropriate storage area for pallets 32 already fully loaded with yarn packages 12.

The middle lay-out of FIG. 5 shows the application of the device 10 to open-end spinning machines 111. In this case the number of yarn packages 12 discharged from a spinning machine 111 is normally the same as the number of yarn packages 12 which form a full load on a pallet 32.

Thus, the simplest and most advantageous lay-out provides for the palletisation device 10 to bear a pallet 42 with cardboard sheets and to load a full load 21 of yarn packages 12 on a pallet 32.

The pallet thus fully loaded will be conveyed thereafter by the device 10 to an appropriate storage point, where the load will be discharged by roller conveyors 43 with which the device 10 is equipped. An empty pallet 32 may be taken onto the device 10 at that storage point.

The movement of pallets 42 holding cardboard sheets 30 may take place in an analogous manner.

The righthand part of FIG. 5 shows a case where boxes 46 to feed yarn packages or other suitable type of supports are loaded in an orderly manner. In this example the device 10 cooperates with conveyors 47 that remove full boxes 49 and with conveyors 48 that feed empty boxes 50.

In this case too, as in the example of the lefthand side of FIG. 5, the boxes 46 of yarn packages may be only partly filled and can be taken from their temporary lodgements at the production machines 11 during subsequent operations of the device 10.

The ability to move the trolley 25 out of the device 10 in two directions in all the lay-outs shown enables the loading of a pallet 32 with yarn packages 12, for instance, to be completed and the pallet 32 to be kept available in a provisional storage area; it also enables the loading of a second pallet 32 or other types of support with yarn packages 12 to be begun and, where the loading cannot be completed, the pallet to be placed in readiness in a zone which is an opposed counterpart of the previous storage area, and lastly the loading of yarn packages 12 on the pallet 32 to be re-started so that the pallet 32 when completely loaded can be conveyed to an appropriate storage point.

I claim:

1. A device to palletise yarn packages which is suitable for installation downstream of machines that produce such yarn packages, the yarn packages being engaged substantially at the outlet of their production machine so as to be loaded in an orderly manner on means for supporting the yarn packages, the palletisation device comprising:

a movable support structure able to support additional structures;

means, mounted on said movable support structure, for transferring said yarn packages onto said movable support structure;

means, mounted on said movable support structure, for engaging and moving said yarn packages and for positioning said yarn packages on said means for supporting the yarn packages means, mounted on said movable support structure for engaging, moving and positioning cardboard sheet supports and pallets; and at least two side-by-side work stations provided. on said movable support structure, each of said work stations including means for supporting and moving at least one of yarn packages and cardboard sheet supports for movement in two directions, said two directions being orthogonal to a direction of forward movement of the movable support structure, whereby this orthogonal movement in two directions permits work to be carried out on both sides of the device.

2. A device as claimed in claim 1, in which the means for supporting and moving at least one of yarn packages and cardboard sheet supports include movable trolleys.

3. A device as claimed in claim 1, in which the means for supporting and moving at least one of yarn packages and cardboard sheet supports include roller conveyors.

4. A device as claimed in claim 1, in which the means for supporting and moving at least one of yarn packages and cardboard sheet supports include chains.

5. A device as claimed in claim 2, in which the trolleys can be positioned to at least partially extend outside the movable support structure momentarily.

6. A device as claimed in claim 2, in which the trolleys include pallet-holder platforms which can be raised vertically.

7. A device as claimed in claim 2, in which the trolleys have independent means for raising a pallet-holder platform.

8. A device as claimed in claim 2, including elements to connect the trolleys to means which lift the pallets.

9. A device as claimed in claim 1, in which the pallets include means cooperating directly with connection elements integrally fixed to lifting means.

10. A device as claimed in claim 2, in which the trolleys cooperate, outside the movable support structure, with stationary stations where pallets loaded with at least one of yarn packages and cardboard sheets are moved.

11. A device as claimed in claim 2, further including stationary work stations comprising means for guiding the trolleys and means to support loaded pallets.

12. A device as claimed in claim 3, in which the roller conveyors are equipped with their own motors.

13. A device as claimed in claim 3, in which the roller conveyors cooperate with analogous roller conveyors included in a stationary work station.

* * * * *